US005442856A

United States Patent [19]

Moody

[11] Patent Number: 5,442,856

[45] Date of Patent: Aug. 22, 1995

[54] SURVIVAL AND CAMPING TOOL

[76] Inventor: James A. Moody, 39554 Grand River Ave., Novi, Mich. 48375

[21] Appl. No.: 250,823

[22] Filed: May 31, 1994

[51] Int. Cl.[6] ..... B26B 3/00

[52] U.S. Cl. ..... 30/314; 30/299; 30/317; 30/318; 30/353

[58] Field of Search ..... 30/299, 314, 317, 340, 30/353, 356, 357, 308.1, 318

[56] References Cited

U.S. PATENT DOCUMENTS

| | | | |
|---|---|---|---|
| 80,242 | 7/1868 | Tongue . | |
| 164,880 | 6/1875 | Shelton | 30/314 |
| 483,588 | 10/1892 | Sunderlin | 30/353 |
| 706,107 | 8/1902 | Prentiss . | |
| 745,162 | 11/1903 | Donnelly . | |
| 1,038,448 | 9/1912 | Scioneaux | 30/317 |
| 1,398,850 | 11/1921 | Franco | 30/314 X |
| 1,971,689 | 8/1934 | Mamay | 30/317 X |
| 2,116,852 | 5/1938 | Stanford et al. . | |
| 2,335,497 | 11/1943 | Ehrsam . | |
| 2,635,337 | 4/1953 | Mercy . | |
| 4,283,854 | 8/1981 | Austin | 30/314 |
| 4,955,139 | 9/1990 | Clotten et al. | 30/340 |
| 5,359,778 | 11/1994 | Seber et al. | 30/294 |

FOREIGN PATENT DOCUMENTS

| | | | |
|---|---|---|---|
| 66736 | 4/1948 | Denmark | 30/314 |
| 4015347 | 11/1991 | Germany | 30/356 |

*Primary Examiner*—Eugenia Jones
*Attorney, Agent, or Firm*—Charles W. Chandler

[57] ABSTRACT

A survival and camping tool having an elongated blade with one end terminating in a handle. The blade has a linear side edge that terminates in a circular tip. The opposite side edge has a belly-shaped configuration that begins with the base of the handle and terminates generally along the longitudinal axis of the tool, in a hook that opens on the same side as the belly. The tool has sufficient weight that the blade can be used for chopping, and the cutting edge of the hook can be used for cutting lighter materials.

7 Claims, 1 Drawing Sheet

SURVIVAL AND CAMPING TOOL

BACKGROUND OF THE INVENTION

This invention is related to survival tools and more particularly to a tool having a curved cutting edge and sufficient weight that it can be used for chopping relatively heavy articles, and a hook-shaped configuration for cutting smaller articles.

Cutting tools have a variety of configurations, but typically have a handle at one end for the user to grasp the tool, and a flat blade at the other end having a cutting edge shaped according to the nature of the materials being cut. Prior art may be found in U.S. Pat. Nos. 80,242 which was issued Jul. 21, 1868 to S. J. Tongue for "Mincing Cleaver"; 164,880 which was issued Jun. 22, 1875 to E. T. Shelton for "Tobacco Knife"; 706,107 which was issued Aug. 5, 1902 to Charles W. Prentiss for "Fruit Knife"; 745,162 which was issued Nov. 24, 1903 to E. P. Donnelly for "Combined Cleaver and Knife"; 2,116,852 which was issued May 10, 1938 to Everett R. Stanford and Howard V. Smith for "Combination Forestry Implement"; 2,335,497 which was issued Nov. 30, 1943 to Frederick Ehrsam for "Implement and Method of Making Same"; 2,635,337 which was issued Apr. 21, 1953 to Lee Mercy for "Notched Linoleum Cutting Knife"; and 4,283,854 which was issued Aug. 18, 1981 to Marvin L. Austin for "Hunter's Knife".

SUMMARY OF THE INVENTION

The broad purpose of the present invention is to provide an improved survival and camping tool having a body formed of an elongated sheet of Swedish spring steel having a relatively high carbon content which is easy to sharpen and holds an edge. The body has a handle tang at one end about 5" long. The total length of the product is about 16" long. The blade has a linear edge that begins at the base of the handle, and terminates with a circular tip. The linear edge can be either straight, serrated or formed with a saw-tooth edge. The linear edge is disposed at an acute angle with respect to the longitudinal axis of the tool.

The opposite side edge of the blade has an arcuate configuration forming a belly that begins at the base of the handle and terminates closely adjacent the longitudinal axis of the tool. A laterally extending edge from the outer end of the belly extends to the circular tip to form a hook that opens on the same side of the tool as the belly. The width of the blade at the belly is slightly less than a third of the overall length of the tool. The tool weighs about $2\frac{1}{2}$ lbs. so as to be sufficiently hefty for use in the manner of a hatchet for relatively large materials. The hook has a cutting edge used to cut smaller materials. The hook is on the same side as the belly so the user does not have to reverse the tool in order to cut larger items and then smaller items.

The handle is somewhat cocked with respect to the sharp edge of the belly in order to protect the user's hand.

The tool can be used for other purposes such as a shovel, or to pound nails and the like. It can be used to replace an axe.

Still further objects and advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF A PREFERRED EMBODIMENT

Figure 1:
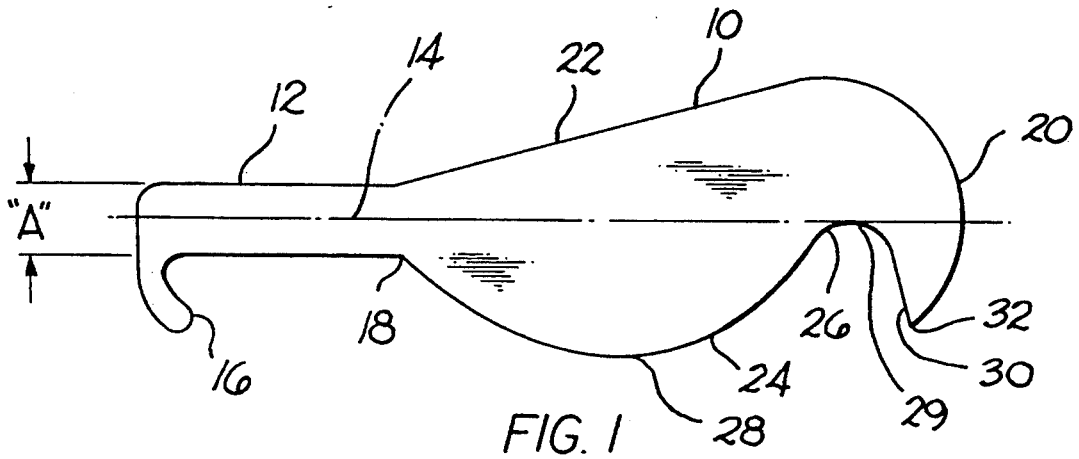
FIG. 1 is a view of the metal body or blade of the preferred embodiment of the invention.
Figure 2:
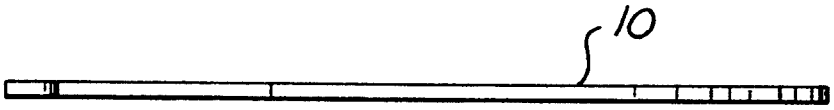
FIG. 2 is a view along one side of the body to show its uniform thickness.

Referring to the drawing, the preferred survival tool has an elongated metal body 10 about 16" long. The body is preferably formed of a high carbon Swedish spring steel with about 2% nickel. The advantage of this material is that it holds an edge, is easy to sharpen and acquires a patina. The body has a thickness of about $\frac{1}{8}$" thick.

The body has a handle tang 12 at one end with parallel side edges defining a width "A" of about $1\frac{1}{8}$", and is formed along a longitudinal axis 14. The outer end of the handle has a hook 16 which is used in a manner that will be presently described.

The length of the handle from the outer end to base 18 is about 5" long.

The body has a tip 20 with an arcuate, preferably circular configuration that extends on both sides of axis 14. For illustrative purposes the tip has a radius of about 2.1279".

The body has one side edge 22 formed along a tangent to the circular tip that extends to base 18 of the handle. Side edge 22 is illustrated as having a straight unsharpened edge. However, it can be formed with either a serrated edge of a saw-tooth edge.

The body on the opposite side of axis 14 has a convex belly 24 preferably formed with an arcuate configuration with a circular midsection or apex. One end of the belly terminates with base 18 of the handle. The other end of the belly terminates at a location 26 closely adjacent the longitudinal axis of the tool. The apex 28 of the belly, that is the part farthest from side 22 is about $4\frac{3}{8}$" from side 22. This is approximately the widest part of the blade. The width of the blade at point 26 is about $2\frac{3}{4}$".

The belly merges at point 26 with a concave curved section 29 formed with a radius of about 0.81" and then in a linear section 30 that extends laterally to form a point 32. Point 32 is about $2\frac{3}{8}$" from longitudinal axis 14. The width of the tool at the circular point is several times wider than the tang of the tool. Further the width of the tool at point 32 is generally just slightly less than the width of the tool at the apex of the belly. The tool is sharpened from point 32 continuously around and along the belly to base 18 of the handle tang.

Figure 3:
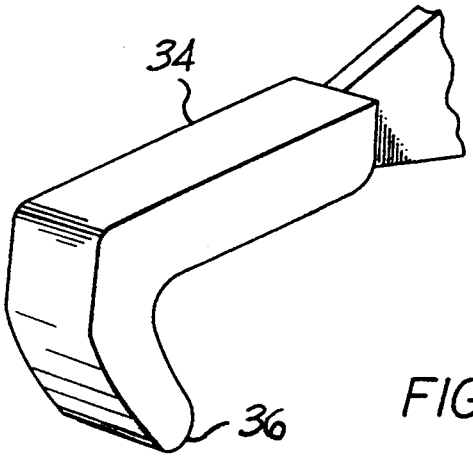
FIG. 3 is a perspective view showing a handle mounted on the tang of the body.

Referring to FIG. 3, a hard rubber grip 34 is mounted on the handle tang including hook 16 to provide a comfortable grip for the user's hand. Hook 16 and the handle at 36 prevent the tool from slipping out of the user's hand when he is engaged in a chopping motion. The weight of the tool is about 2 lbs. so that it has sufficient weight to replace some of the functions of an axe; it can be used as a shovel, for pounding nails or for cutting relatively small articles. It-is normally mounted in a holster carried on the user's belt (not shown).

Having described my invention, I claim:

1. A survival and camping tool, comprising:

an elongated thin metal body formed of a sheet of metal of a uniform thickness and having a first side edge and a second, opposite side edge;

the first side edge having a hook-shaped section adjacent one end thereof with a sharp edge defining an opening facing away from the second side edge and terminating in a point disposed a distance from the second side edge, the first side edge having a convex belly section with an arcuate cutting edge, the belly section having an apex disposed a distance perpendicular to the second side edge generally corresponding to the distance of the point of the hook-shaped section perpendicular to the second side edge, the body having a handle tang at the end of the body opposite the hooked-shaped section;

a handle mounted on the handle tang;

the second side edge having a linear configuration; and one end of the belly terminating at said hook-shaped section and the opposite end of the belly terminating at said handle tang, the body having its greatest width at the apex of the belly at a point generally midway between the hook-shaped section and the handle tang.

2. A survival and camping tool, comprising:

an elongated body formed of a sheet of metal having a uniform thickness;

the body having a first end with a handle tang formed along a longitudinal axis, the tang having an outer end and a base;

the body having an opposite arcuate end extending on opposite sides of said longitudinal axis and being wider than said handle tang, the body having a first side edge forming a tangent from one end of said arcuate end, along a line that intersects the base of the handle tang, and disposed on one side of said longitudinal axis;

the body having a second side edge including a convex, generally arcuate-shaped belly with a sharpened edge on the opposite side of said longitudinal axis, one end of the belly merging with the base of the handle tang, the opposite end of the belly terminating adjacent said longitudinal axis approximate the arcuate end, and including a generally laterally-extending cutting edge connected to said opposite end of the belly and joining the arcuate end to form an acute cutting tip on the same side of the body as the belly, the body having its greatest width at the apex of the belly at a point generally midway between the laterally-extending cutting edge and the base of the tang.

3. A tool as defined in claim 2, in which the length of the handle tang is about $\frac{1}{3}$ the length of the body.

4. A tool as defined in claim 2, in which the belly has a partially circular configuration including an apex, disposed a distance perpendicular tto he first side edge which is greater than $\frac{1}{3}$ the distance from the base of the handle tang to the arcuate end of the body.

5. A tool as defined in claim 4, in which the width of the tool from the first side edge to the apex of the belly generally corresponds to the width of the tool from the first side edge to the acute cutting tip.

6. A tool as defined in claim 2 in which the outer end of the handle tang has a hook-shaped configuration.

7. A survival and camping tool, comprising:

an elongated body formed of a sheet of metal having a uniform thickness;

the body having a first end with a handle tang formed along a longitudinal axis, the tang having an outer end and a base;

the body having an opposite arcuate end extending on opposite sides of said longitudinal axis and being wider than said handle tang, the body having a first side edge forming a tangent from one end of said arcuate end, along a line that intersects the base of the handle tang, and disposed on one side of said longitudinal axis;

the body having a second side edge including a convex, generally arcuate-shaped belly with a sharpened edge on the opposite side of said longitudinal axis, one end of the belly terminating with the base of the handle tang, the opposite end of the belly terminating adjacent said longitudinal axis approximate the arcuate end, and including a generally laterally-extending cutting edge connected to said opposite end of the belly and joining the arcuate end to form an acute cutting tip on the same side of the longitudinal axis as the belly, the body having its greatest width at the apex of the belly at a point generally midway between said opposite end of the belly and the base of the tang;

the laterally extending cutting edge being formed along a line extending perpendicular to an extension of said first side edge; and the laterally-extending cutting edge facing the belly, and including a concave cutting edge connecting the laterally extending cutting edge to the belly to form a notch facing away from the first side edge.

* * * * *